US010702882B2

(12) United States Patent
Heise et al.

(10) Patent No.: US 10,702,882 B2
(45) Date of Patent: Jul. 7, 2020

(54) METHOD AND SYSTEM FOR THE SELECTIVE COATING OF AN INTERIOR SURFACE

(71) Applicant: CORNING INCORPORATED, Corning, NY (US)

(72) Inventors: Karl Robert Heise, Bath, NY (US); Jeffrey Allen Miller, Elmira, NY (US); Haregewine Tadesse Woldegiworgis, Horseheads, NY (US)

(73) Assignee: CORNING INCORPORATED, Corning, NY (US)

( * ) Notice: Subject to any disclaimer, the term of this patent is extended or adjusted under 35 U.S.C. 154(b) by 791 days.

(21) Appl. No.: 14/924,964

(22) Filed: Oct. 28, 2015

(65) Prior Publication Data

US 2016/0121353 A1 May 5, 2016

Related U.S. Application Data

(60) Provisional application No. 62/072,567, filed on Oct. 30, 2014.

(51) Int. Cl.

| | |
|---|---|
| ***B05B 13/06*** | (2006.01) |
| ***B05B 12/02*** | (2006.01) |
| ***B05D 1/02*** | (2006.01) |
| ***B05D 7/22*** | (2006.01) |

(Continued)

(52) U.S. Cl.

CPC ..... *B05B 13/0618* (2013.01); *B05B 12/20* (2018.02); *B05D 1/32* (2013.01); *B05D 7/22* (2013.01)

(58) Field of Classification Search

None

See application file for complete search history.

(56) References Cited

U.S. PATENT DOCUMENTS

| | | | | |
|---|---|---|---|---|
| 4,952,420 | A * | 8/1990 | Walters | C23C 14/042 427/272 |
| 7,445,697 | B2 * | 11/2008 | Keigler | C25D 21/12 118/500 |
| 8,389,050 | B2 | 3/2013 | Buck et al. | |

(Continued)

FOREIGN PATENT DOCUMENTS

| | | |
|---|---|---|
| WO | 2009131447 | 10/2009 |
| WO | 2010051109 | 5/2010 |

*Primary Examiner* — Jethro M. Pence

(74) *Attorney, Agent, or Firm* — Gregory V. Bean

(57) ABSTRACT

The present disclosure relates, in various embodiments, to methods and systems for masking and de-masking a portion of an interior surface of a structure, such as may be useful in the selective coating of an interior surface of a structure. The method comprises providing a masking device comprising a magnetically active material and a seal-forming material and inserting the masking device into an interior of the structure. A magnetic force is activated in order to bring the masking device into sealable contact with a portion of an interior surface of the structure, thereby producing a masked portion of the interior surface. While maintaining the sealable contact, the unmasked portion of the interior surface of the structure is coated with a coating material. After the coating, the magnetic force is deactivated in order to bring the masking device out of sealable contact with the interior surface of the structure.

10 Claims, 2 Drawing Sheets

(51) Int. Cl.
*B05B 12/20* (2018.01)
*B05D 1/32* (2006.01)

(56) References Cited

U.S. PATENT DOCUMENTS

| | | | | |
|---|---|---|---|---|
| 8,773,848 | B2 | 7/2014 | Russell-Clarke et al. | |
| 2010/0101492 | A1* | 4/2010 | Sarajian ..... | B05B 12/26 118/504 |
| 2010/0233365 | A1 | 9/2010 | Gajsin et al. | |
| 2013/0076612 | A1 | 3/2013 | Myers | |
| 2013/0188366 | A1 | 7/2013 | Russell-Clarke et al. | |

* cited by examiner

METHOD AND SYSTEM FOR THE SELECTIVE COATING OF AN INTERIOR SURFACE

This application claims the benefit of priority under 35 U.S.C. § 119 of U.S. Provisional Application Ser. No. 62/072,567 filed on Oct. 30, 2014 the content of which is relied upon and incorporated herein by reference in its entirety.

BACKGROUND

The disclosure relates to systems and methods for selectively coating an interior surface of a structure, and more particularly to systems and methods for using a magnetically controlled masking unit to mask and de-mask a portion of an interior surface of a structure, such as a tube or sleeve, so that a coating may be selectively applied to a desired portion of the interior surface.

SUMMARY

The present disclosure relates, in various embodiments, to systems for masking and de-masking a portion of an interior surface of a structure, such as may be useful in the selective coating of an interior surface of a tube-like structure or sleeve-like structure. The system comprises a masking unit that comprises a paddle, the paddle including at least a body and a handle. The body of the paddle comprises a magnetically active material, and a seal-forming material. The system also comprises an object that is capable of producing a magnetic force that acts on an interior cavity of the structure. The paddle is configured to be inserted into the interior cavity of the structure and acted on by the magnetic force such that the magnetic force causes the paddle to sealably contact a portion of the interior surface of the structure. The paddle is also configured such that when the magnetic force is removed, the paddle returns to a position in which it does not contact the interior surface of the structure.

The present disclosure also relates, in various embodiments, to methods for selectively coating a portion of an interior surface of a structure, such as for example a tube-like structure or a sleeve-like structure. The method comprises providing a masking device comprising a magnetically active material and a seal-forming material and inserting the masking device into an interior cavity of the structure. Once the masking device is inserted into the interior cavity of the structure, a magnetic force is activated so as to act on the masking device in order to bring the masking device into sealable contact with a portion of an interior surface of the structure, thereby producing a masked portion of the interior surface. While maintaining the sealable contact, the unmasked portion of the interior surface of the structure is coated with a coating material. After the coating, the magnetic force is deactivated in order to bring the masking device out of sealable contact with the portion of an interior surface of the structure, at which point the masking device may be removed from the interior cavity of the structure.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
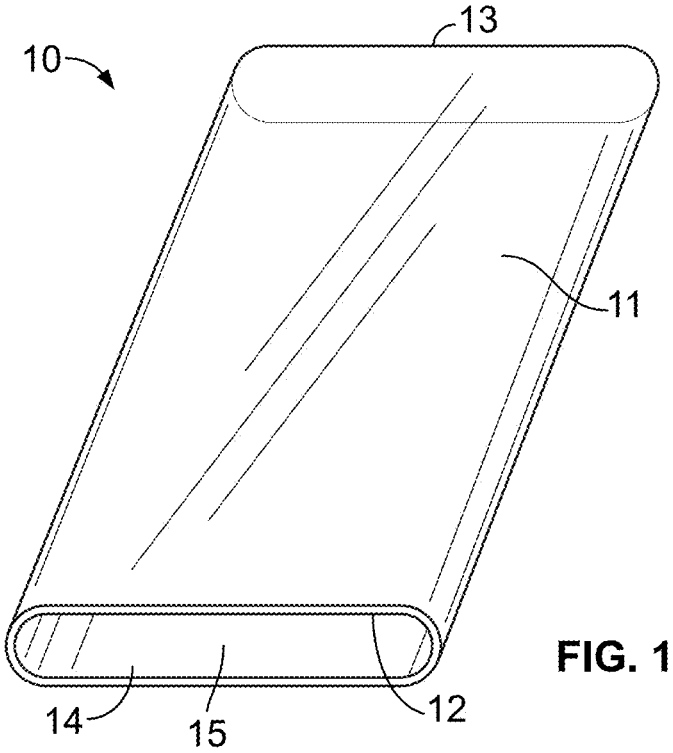
FIG. 1 is a perspective view of a glass sleeve of the sort that may be selectively coated using embodiments of the systems and methods disclosed herein.

Reference will now be made in detail to the present preferred embodiment(s), examples of which are illustrated in the accompanying drawings. Whenever possible, the same reference numerals will be used throughout the drawings to refer to the same or like parts. One embodiment of a structure of the sort that may be selectively coated using the systems and methods described herein is shown in FIG. 1, and is designated generally throughout by the reference numeral 10.

The "sleeve" illustrated in FIG. 1 comprises an outer (or external) surface 11 and an inner (or internal) surface 12. The internal surface 12 is bordered by an interior cavity 15, which may be accessed via an upper opening 13 and a lower opening 14. Although the sleeve 10 illustrated in FIG. 1 comprises continuous outer and inner surfaces, the sleeve can also be configured to have, for instance, a front wall, a rear wall, and a pair of side walls. Sleeves of the type illustrated in FIG. 1 are finding increased usage in electronic devices, such as mobile devices, phones, tablets, and wearable technology. More particularly, the sleeve 10, which may be prepared from glass or from a transparent plastic, transparent ceramic, or transparent composite material, may be used as a housing to enclose an electronic device.

It is often desirable that only a portion of an electronic device, such as a display screen, is visible through the housing. As such, it may be desirable to selectively coat a portion of the sleeve 10 and more preferably a portion of the interior surface 12 of the sleeve with an ink in order to render certain electronic components not visible. It may also be desirable to selectively coat a portion of the interior surface 12 of the sleeve in order to provide portions of the sleeve with one or more of a variety of properties, including but not limited to scratch resistance, wear resistance, adhesive properties, wettability, corrosion resistance, anti-reflective properties, anti-glare properties, anti-splinter properties, and anti-microbial properties.

However, the selective coating of interior surfaces of a structure using conventional masking and coating processes is problematic. Conventional processes for selective coating of a structure are directed to the masking and coating of an outer surface of a structure. These conventional processes are not suitable for the selective coating of an interior surface of a structure, which requires a masking unit to access the interior cavity of the structure. The problems associated with selective coating of an interior surface of a structure are compounded where the width 16 of the interior cavity is small, such as may often be the case when the structure is a housing for an electronic device.

Embodiments of the methods and systems disclosed herein overcome the problems associated with the selective coating of an interior surface 12 of a structure by employing a magnetically controlled masking unit 20 to mask and de-mask a portion of an interior surface of the structure so that a coating may be selectively applied to a desired portion of the interior surface. The methods and systems described herein may be suitable wherever the selective coating of an interior surface 12 of a structure is desired. For instance, embodiments of the methods and systems disclosed herein may be used to coat any variety of display materials, medical items, automobile components, furniture, industrial equipment, consumer items, and the like.

The structure 10 being selectively coated by the methods disclosed herein may be prepared to a desired thickness and thus have a desired degree of flexibility. The methods and systems disclosed herein may be utilized to coat surfaces that are flexible, such as surfaces of thin structures, as well as surfaces of rigid structures. The structure 10 being selectively coated by the methods disclosed herein may also take on many shapes. For example, in some embodiments, the structure may comprise a surface having a high degree of curvature. The structure being selectively coated may also comprise only one opening through which the interior cavity may be accessed, as opposed to the multiple openings of the sleeve 10 shown in FIG. 1.

Figure 2:
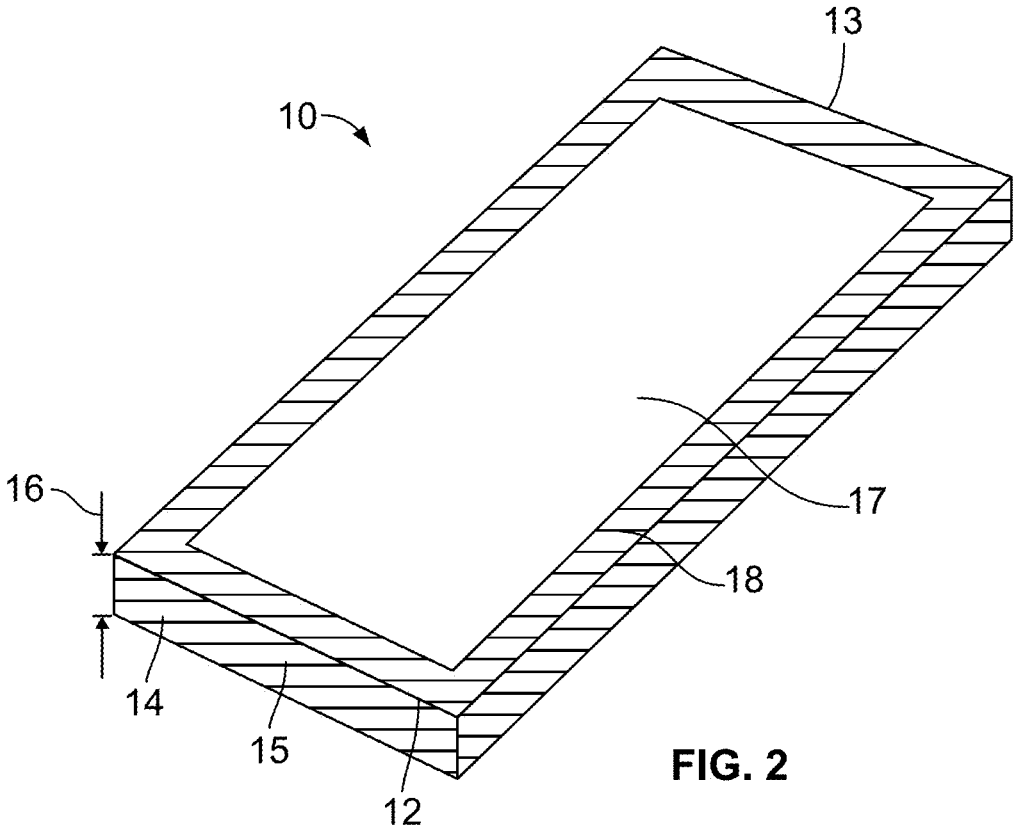
FIG. 2 is a perspective view of one embodiment of a sleeve selectively coated using an embodiment of the system and method disclosed herein.

One embodiment of a selectively coated sleeve 10 is shown in FIG. 2. The sleeve 10 has been coated so as to include an uncoated region 17, in this embodiment a viewing aperture, on a front face of the sleeve. The viewing aperture is surrounded by a coated region 18, which is indicated in FIG. 2 by diagonal hatching. The term viewing aperture, as used herein, is meant to include any non-coated portion of a sleeve 10 or other structure that is configured to align with a video display area in order to provide a user with the ability to view the display area. A viewing aperture is not limited by the embodiment shown in FIG. 2 and may take on a variety of shapes, sizes, and positions on the structure 10 without departing from the scope of the disclosure.

Although FIG. 2 shows a sleeve 10, such as may be used as the housing for a cell phone or tablet device, in which the interior surface 12 has been selectively coated to provide an uncoated region 17 of rectangular shape, the methods and systems disclosed herein may be used to selectively produce an interior surface 12 having one or more uncoated regions 17, with each uncoated region taking on any of a variety of configurations. For example, in some embodiments, the methods and systems disclosed herein may be used to selectively produce an uncoated region 17 having a circular or ovoid shape. Additionally, in some embodiments, the uncoated region 17 may be positioned away from the center of the surface 12 such as, for example, in one or more corners or along one or more sides of the surface. The methods and systems described herein may also be used to selectively coat an interior surface 12 so as to provide multiple uncoated regions 17 on the interior surface. For example, the interior surface 12 may be selectively coated in order to comprise both a viewing aperture and a camera aperture.

In some embodiments, the methods and systems described herein may be used in order to selectively coat one or more opposing interior surfaces 12 of a structure 10, such as a sleeve. This may be achieved through the use of one or more masking units 20. For example, in some embodiments, careful control over magnetic forces may provide for the simultaneous masking of opposing sides of an interior cavity 15 using multiple masking units 20. Alternatively, the selective coating of opposing interior surfaces 12 of a structure 10 may be achieved, for example, by isolation of a first interior surface of the structure from the interior cavity 15 during a first selective coating step in which a second interior surface of the structure is masked and coated, followed by a second selective coating step in which the second interior surface (that was coated during the first selective coating step) is isolated from the interior cavity and the first interior surface (that was isolated during the first selective coating step) is masked and coated.

Moreover, although FIG. 2 show a sleeve 10 in which the unmasked region has a substantially flat surface, the methods and systems disclosed herein may also be used to selectively produce one or more uncoated regions on curved surfaces, such as may be present when the structure is a tube or the like. For example, embodiments of the methods and systems disclosed herein may be used to selectively coat an interior surface of a tube, a flattened tube, or a curved sleeve.

The methods and apparatuses of the present disclosure may be particularly useful for the masking and selective coating of structures 10 having small dimensions. These structures include, but are not limited to, sleeves and tubes that may be configured for housing electronic components, such as in mobile phones and other mobile electronic devices. For example, in some embodiments, the interior cavity 15 of a structure, such as a sleeve, has a width 16 that is less than about 12 mm, alternatively less than about 10 mm, alternatively less than about 8 mm, alternatively less than about 6 mm, alternatively less than about 5 mm. For example, in some embodiments, the structure may have an interior cavity 15 having a width 16 that is between about 3 mm and about 10 mm.

Figure 3:
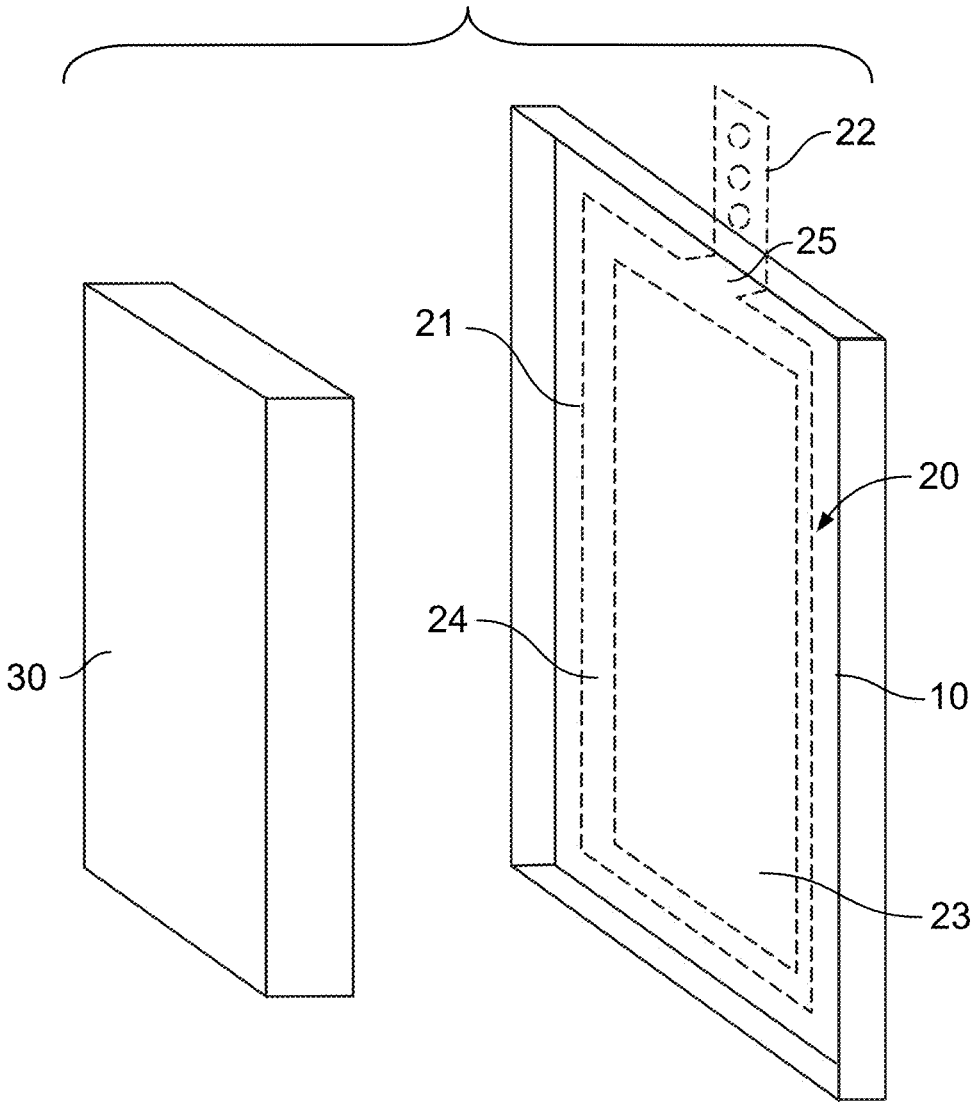
FIG. 3 is a perspective view of one embodiment of a system for masking and de-masking a portion of an interior surface of a structure.

Systems for Masking and De-Masking a Portion of an Interior Surface of a Structure Embodiments of the system disclosed herein comprise a masking/de-masking apparatus that comprises a masking unit, or paddle, 20 and a magnetic source 30. An embodiment of the apparatus disclosed herein is illustrated in FIG. 3. The masking unit, or paddle, 20 comprises at least a body 21 and a handle 22. Because the body 21 is configured to mask a portion of the interior surface of a structure 12 during a coating step, the body is preferably shaped so as to correspond with the desired uncoated region 17 of the structure. For example, the body 21 of the embodiment shown in FIG. 3 is configured to provide a sleeve 10 with a centrally located, rectangular viewing aperture such as that illustrated in FIG. 2.

The body 21 comprises at least a magnetically active material 23 and a seal forming material 24. The magnetically active material 23 may be any material that is configured to be attracted by a magnetic force. In some embodiments, the body of the paddle 21 may be formed of a magnetically active material 23. For example, the body of the paddle 21 or a portion of the body of the paddle may be formed of a magnetically active stainless steel, which is easy to clean and maintain. Alternatively, in some embodiments, the body of the paddle 21 may be formed of a non-magnetically active material, such as a plastic, and the magnetically active material 23 may be provided as a coating on the body or on a portion of the body or as a material within the body. Where the magnetically active material 23 is provided as a coating or as a material within the body, it is important that it be present in an amount sufficient to provide for the movement of the paddle 20 into a masking position in response to the magnetic force.

The seal forming material 24 is configured to form a seal with the interior surface 12 that the masking unit 20 is configured to mask. The sealing material 24 is positioned at least around the perimeter of the body 21. In some embodiments, such as that illustrated in FIG. 3, the sealing material 24 may cover only a thin strip along the perimeter of the face of the body 21. In other embodiments, the sealing material 24 may cover a more substantial portion of the face of the paddle body 21. In some embodiments, the sealing material 24 may cover the entire face of the paddle body 21. The degree of coverage of the sealing material 24 may be selected depending on the efficiency of the sealing material and the strength of the magnetic attraction between the magnetic source 30 and the magnetically active material 23.

The sealing material 24 may be selected from a variety of materials that form a seal between the paddle body 21 and the interior surface 12 that the masking unit 20 is configured to mask. For example, the sealing material 24 may comprise a silicon-based sealing material, a foam tape, a strong double-sided tape, or a rubber-like sealing material. In some embodiments, polymer-based sealants, such as silicone-based sealants, may be preferred. The coating material that the system is configured to coat on the interior surface 12 of a structure may also play a role in selecting the sealing material 24. For example, certain sealing materials 24 may interact with certain coating materials so as to repel the coating material, which will result in an additional uncoated space surrounding the masked region 17. Accordingly, it may be important to select a sealing material 24 that does not interact with the coating material, particularly where the boundary between the coated region 18 and the masked region 17 are to be very precise.

Although the magnetically active material 23 and the seal forming material 24 are described above as distinct components, it is also contemplated that embodiments of the paddle body 21 may comprise a mixture or blend of sealing material and magnetically active material without departing from the scope of the present disclosure. For instance, in some embodiments, the paddle body 21 may comprise a rubber-like sealing material having magnetically active particles dispersed therein.

In embodiments that are configured for the masking of a flat or substantially flat surface 12, it may be desirable that the paddle body 21 is substantially flat. Alternatively, where the system is configured for the masking of a surface 12 having a degree of curvature, it may be desirable that the paddle body 21 is curved to better coincide with the curvature of the surface.

The handle 22 is configured to flex so that the body of the paddle 21 may move between a masking position, in which a portion of the interior surface 17 of a structure is masked by the paddle body 21, and an unmasking position, in which the paddle body does not contact the interior surface of the structure. Accordingly, when a magnetic force of sufficient strength acts on the magnetically active material 23 of the masking unit 20, the handle 22 is configured to flex so that the paddle body 21 comes into sealing contact with a portion of an interior surface 17 of a structure. And when the magnetic force of sufficient strength is removed, the handle is configured to return to its natural position so that the paddle body 21 is brought out of contact with an interior surface 12 of the structure. The handle 22 is also preferably configured so that it does not contact the interior surface of the structure 12, either when the paddle 20 is brought into a masking position or when the paddle is brought into an unmasking position.

The handle 22 may extend from one end of the body 21. The handle 22 may be attached to the body 21 or may be integrally formed with the body. In some embodiments, for example, the handle 22 may be attached to either the rear of the body 21 or the top of the body. Alternatively, the handle 22 may be integrally formed with either the rear of the body 21 or the top of the body. The handle 22 may be formed from the same material as the paddle body 21 or it may be formed from a different material than the paddle body.

In some embodiments, the handle 22 may be configured to minimize the overall thickness of the paddle. This may be particularly desirable where the interior cavity 15 of the structure that the system is configured to coat is narrow. For example, in some embodiments, the handle 22 may extend substantially straight upward from either the rear surface or the top surface of the body 21. Alternatively, the handle 22 may be joined with the body 21 by a short joining portion 25. The joining portion 25 may be configured to prevent the accumulation of coating material. For example, the joining portion 25 may form an angle with the paddle body 21 that promotes the draining of the coating material from the upward-facing surfaces of the paddle body and the handle 22. In some embodiments, the handle 22 may also desirably be formed of a thin material, which will both increase flexing and reduce the overall thickness of the paddle.

The paddle 20 is configured to be inserted into the interior cavity 15 of the structure that the system is configured to coat. In some embodiments, the system is configured so that the paddle 20 can be inserted into and removed from the interior cavity 15 of the structure without contacting any of the interior surfaces 12. For instance, in some embodiments, the overall thickness of the paddle 20 may be carefully controlled so as to allow for the paddle to be inserted into and removed from the interior cavity 15 of a structure without interfering with the coating that is applied on the interior surface or surfaces 12.

In some embodiments, the overall thickness of the paddle 20 is less than 12 mm, alternatively less than 10 mm, alternatively less than 8 mm, alternatively less than 7 mm, alternatively less than 6 mm, alternatively less than 5 mm. For example, in some embodiments, the overall thickness of the paddle 20 is between about 1 and about 5 mm, alternatively between about 1.5 and about 4.5 mm. The overall thickness of the paddle is the distance between the front surface of the sealing material 24 and the rear surface of the paddle, which depending on the configuration of the paddle may be either a rear surface of the body 21 or a rear surface of the handle 22. For example, the paddle body 21 may have a thickness of about 1.5 mm and the sealing material 24 may have a thickness of about 2.5 mm, providing a paddle 20 with an overall thickness of about 4 mm.

In some embodiments, it may also be important to provide a minimum distance between the front and rear surfaces of the paddle 20 and the interior surfaces 12 of the structure. For example, in some embodiments, the paddle 20 may be configured to have an overall thickness that is at least about 2 mm less than the width of the interior cavity 16 of the structure that the system is configured to mask. Alternatively, the paddle 20 may be configured to have an overall thickness that is at least about 4 mm less than the width of the interior cavity 16 of the structure that the system is configured to mask.

The magnetic source 30 comprises an object that is capable of producing a magnetic force. The magnetic source 30 is arranged so that it may be located a distance from the structure 10 and the masking unit 20 that is sufficient so that the magnetic source may produce a magnetic force that acts on the interior cavity 15 of the structure. The magnetic source 30 may be a permanent magnet or an electromagnet.

In some embodiments, particularly where the magnetic source 30 is a permanent magnet, the magnetic source may be configured so as to be moved between at least a first position, which is located a first distance from the masking unit 20, and a second position, which is located a second distance from the masking unit. For instance, the magnetic source 30 may be attached to a motor to provide for a motorized movement between at least the first position and the second position.

When in the first position, the magnetic source 30 is located a distance from the masking unit 20 such that the permanent magnet produces a magnetic force that acts on an interior cavity 15 of a structure in which the masking unit has been inserted, thereby bringing the masking unit into a masking position, in which the paddle body 21 sealingly contacts a portion of an interior surface 17 of the structure. When in a second position, the magnetic source 30 is located a distance from the masking unit 20 such that the magnetic force acting on an interior cavity 15 of the structure in which the masking unit has been inserted is insufficient to bring the masking unit into a masking position. As such, when the magnetic source 30 is moved from a first position into a second position, the paddle body 21 returns to a de-masking position, in which the paddle body 21 does not contact the interior surface 12 of the structure.

Where the magnetic source is an electromagnet, the electromagnet is capable of being controlled such that in an "on" position it may produce a magnetic force and in an "off" position no magnetic force is produced, such as by control over the current passing through the electromagnet. When in the "on" position, the magnetic source 30 is produces a magnetic force that acts on an interior cavity 15 of a structure in which the masking unit 20 has been inserted, thereby bringing the masking unit into a masking position, in which the paddle body 21 sealingly contacts a portion of an interior surface 17 of the structure. When in the "off" position, the magnetic force acting on an interior cavity 15 of the structure in which the masking unit has been inserted is ceased (or at least decreased such that the magnetic force is sufficiently weakened in strength). As such, when the magnetic source 30 is moved from an "on" position into an "off" position, the paddle body 21 returns to a de-masking position, in which the paddle body 21 does not contact the interior surface 12 of the structure.

The magnetic source 30 may be configured to act across the body of the paddle 21 in order to most effectively bring the body of the paddle into sealing contact with the interior surface 12 of the structure. For example, where the interior surface 12 of the structure that the system is configured to mask is curved, the magnetic source 30 may also be curved in order to more effectively produce a magnetic force that acts on the paddle body 21 to sealingly contact the masked portion of the curved interior surface. The magnetic source 30 may take on any of a variety of three-dimensional shapes in order to provide an effective magnetic force.

The system may also comprise a coating device that is configured to coat the interior surface 12 of the structure. The coating device is configured so that the exterior surfaces 11 of the structure do not come into contact with the coating material. For example, in some embodiments, the coating device may be configured to till the interior cavity 15 of the structure with a coating material, such that the unmasked portions of the interior surface 12 may be coated and the coating material may drain out of the inner cavity, i.e, by a drain coating process. Alternatively, for example, the coating device may be configured to spray coat the unmasked portions of the interior surface 12 of the structure. Other coating configurations that are capable of providing a coating material to an inner cavity 15 of a structure while isolating the outer surfaces 11 of the structure are also contemplated without departing from the scope of the invention.

The system may also comprise a curing device. The curing device may be configured to provide a coated structure with elevated temperature, ultraviolet radiation, or both.

In some embodiments, the masking unit 20 may be capable of masking and de-masking a multitude of structures 10 before it will need to be maintenance or replaced. As such, a system for selectively coating the interior surfaces 12 of structures 10 may be configured to operate in a continuous or semi-continuous manner. Accordingly, the system may be easily incorporated into the production line for a desired structure 10, such as a production line for an electronic housing sleeve of the sort shown in FIG. 2.

Methods for Selectively Coating a Portion of an Interior Surface of a Structure

Embodiments of the method disclosed herein provide for the selective coating of a portion of an interior surface 18 of a structure. Embodiments of the method comprise a step of providing a masking unit 20, the masking unit comprising a magnetically active material 23 and a seal-forming material 24.

The masking unit 20 is inserted into an interior cavity 15 of a structure so as to be positioned at a desired location within the interior cavity of the structure. The masking unit 20 may be inserted into an interior cavity 15 of the structure through any opening. For instance, where the structure contains both an upper opening 13 and lower opening 14, the masking unit 20 may be inserted into the interior cavity 15 through either opening. The masking unit 20 may desirably be inserted into the interior cavity 15 of the structure without contacting any of the interior surfaces 12 of the structure.

Once the masking unit 20 is positioned within the interior cavity 15 of the structure, embodiments of the method comprise a step of activating a magnetic force to bring the body 21 of the masking unit 20, and more specifically the seal-forming material 24, into sealable contact with a portion of an interior surface 12 of the structure, thereby producing a masked portion of the interior surface 17. The magnetic force may be activated in a variety of ways.

In some embodiments, for example, the step of activating the magnetic force may comprise bringing a permanent magnet 30 into proximity with the structure 10 so that the magnetic force produced by the permanent magnet acts on the magnetically active material 23 of the masking unit 20 with sufficient strength to cause the body 21 of the masking unit to be drawn into sealable contact with a portion of the interior surface 12 of the structure. This may be achieved by moving the magnet 30 into a location that causes the making unit 20 to move into its masking position or by moving the structure 10 (in which the masking unit has been inserted) into a location that causes the masking unit to move into its masking position or both. For ease, in some embodiments it may be desirable to move the magnet 30 into proximity to the structure 10 while maintaining the structure in a stationary position.

In other embodiments, for example, the step of activating the magnetic force may comprise causing a current to be passed through an electromagnet 30 in order to create a magnetic force that acts on the magnetically active material 23 of the masking unit 20 with sufficient strength to cause the body 21 of the masking unit to be drawn into sealable contact with a portion of an interior surface 12 of the structure. Use of an electromagnet provides an additional benefit in that the magnetic source 30 and the structure 10 (in which the masking unit 20 has been inserted) need not be moved relative to one another. Rather, in some embodiments both the structure 10 and the electromagnet 30 may be stationary during this step.

The magnitude of the magnetic force that may be required in order to bring the paddle body 21 into a sealing, or masking, position may vary depending on a number of factors, including the size and weight of the paddle body, the flexibility of the handle 22, the amount and degree of attraction of the magnetically active material 23, etc. Where, for example, the masking unit 20 is configured for the masking of an internal surface 12 of a cell-phone sized structure 10 in order to provide a viewing aperture such as is illustrated in FIG. 2, a magnetic force between about 500 N (Newton) and about 600 N may be sufficient to bring the paddle body 21 into its masking position.

In some embodiments, the magnetic force is from about 50 N to about 1500 N. In some embodiments, the magnetic force is from about 50 N to about 1500 N, about 50 N to about 1200 N, about 50 N to about 1000 N, about 50 N to about 800 N, about 50 N to about 600 N, about 50 N, to about 400 N, about 50 N to about 200 N, about 100 N to about 1500 N, about 100 N to about 1200 N, about 100 N to about 1000 N, about 100 N to about 800 N, about 100 N to about 600 N, about 100 N to about 400 N, about 100 N to about 200 N, about 200 N to about 1500 N, about 200 N to about 1200 N, about 200 N to about 1000 N, about 200 N to about 800 N, about 200 N to about 600 N, about 200 N to about 400 N, about 400 N to about 1500 N, about 400 N to about 1200 N, about 400 N to about 1000 N, about 400 N to about 800 N, about 400 N to about 600 N, about 600 N to about 1500 N, about 600 N to about 1200 N, about 600 N to about 1000 N, about 600 N to about 800 N, about 800 N to about 1500 N, about 800 N to about 1200 N, about 800 N to about 1000 N, about 1000 N to about 1500 N, or about 1000 N to about 1200 N. Of course, in some embodiments, less force is expected to be sufficient when the masked region of the surface 17 is smaller and more force may be needed when the masked region of the surface is larger.

While the masking unit 20 is maintained in in sealing contact with a portion of an interior surface 17 of the structure, thereby masking a portion of the interior surface, the unmasked portion of the interior surface 18 is coated with a coating material. The coating may be performed using any coating method that may be configured to coat an interior surface 12 of a structure while not coating an exterior surface 11 of the structure.

In some embodiments, for example, the unmasked portion of the interior surface 12 may be coated by a step of drain coating. During drain coating, a coating material is introduced into the interior cavity 15 of the structure and then drained from the interior cavity of the structure to produce a coated region. In some embodiments, for example, the interior cavity 15 of the structure may be filled with a coating material to ensure that the unmasked portion of the interior surface 12 is contacted by the coating material. The interior cavity 15 of the structure may then be drained to remove the coating material, leaving behind a coated region 18 of the interior surface. In other embodiments, the unmasked portion of the interior surface 12 may be coated by a step of spray coating. In other embodiments, the unmasked portion of the interior surface 12 may be coated by a step of dip coating, although dip coating may require the isolation of the outside surfaces 11 of the structure.

The coating material may be selected to provide the structure 10 with any of a number of desired surface properties. For example, the coating material may be selected to provide the coated portion of the structure 18 with one or more surface property selected from the group consisting of scratch resistance, wear resistance, adhesive properties, wettability, corrosion resistance, anti-reflective properties, anti-glare properties, anti-splinter properties, and anti-microbial properties. In some embodiments, the coating material may be an ink. It is also contemplated that an ink that also provides one or more of the above-listed surface properties could be used without departing from the scope of the present disclosure.

In some embodiments, a coating material having a suitable viscosity and good adhesion characteristics may be selected in order to produce a high-quality and high-precision coating. In some embodiments, a coating material that is UV curable or thermally curable is selected. When the coating material is an ink, the ink may be selected to have a high optical density, which allows for a thin coating that is suitable for blocking visibility into the interior cavity of the structure. Inks that are suitable for use in the selective coating methods described herein include those that are hydrophobic, hydrophilic, or amphiphilic. The inks may also have any of a variety of colors.

The thickness of the coating may vary depending on the desired use. In some embodiments, the coating may have a thickness that is less than 25 μm, alternatively less than 20 μm, alternatively less than 15 μm. For example, the coating may be between about 5 and about 20 μm, alternatively between about 10 and about 15 μm. In some embodiments, it may be desirable that the coating is substantially uniform.

Once the interior surface 12 of the structure has been selectively coated, the de-masking step may take place. In a de-masking step, the masking unit 20 is brought out of sealable contact with the uncoated portion 17 of an interior surface of the structure and removed from the interior cavity 15. During the de-masking step, it may be important that the masking unit 20 not make contact with the coating in such a manner as may result in smudging of the coating, scratching of the coating, or the like.

The de-masking step comprises deactivating the magnetic force, which causes the masking unit 20 to move out of sealable contact with the interior surface 12 of the structure. For instance, when the magnetic force acting on the sealing unit 20 is either removed or sufficiently reduced, the handle 22 moves from its flexed position back to its natural position. This de-flexing of the handle 22 brings the body of the paddle 21 out of contact with the interior surface of the structure 12.

Once the masking unit 20 is moved out of sealable contact with the interior surface 12 of the structure, the masking unit 20 may be removed from the interior cavity 15 of the structure. For example, in the embodiment illustrated in FIG. 3, the masking unit 20 is pulled vertically upward so as to exit the interior cavity of the structure 15 through the upper opening 13. In other embodiments, the motion of the masking unit 20 may differ depending on the orientation of the masking unit 20 and the structure 10. In some embodiments, it may be preferable that the masking unit 20 is removed without making contact with any of the coated interior surfaces of the structure 18. In this way, the coating may be protected against damage, such as smearing or smudging. Accordingly, the motion of the masking unit 20 may be precisely controlled to avoid contact with the interior surface 12 of the structure.

In some embodiments, the coated surface 18 may also undergo a curing step. In some embodiments, curing of the coating may occur simply by drying due to exposure to ambient conditions. In some embodiments, however, curing of the coating may be expedited by exposing the structure to at least one of ultraviolet radiation and elevated temperature. For instance, in some embodiments, the coating may be a UV curable coating. In other embodiments, the use of elevated temperatures may expedite the curing of a coating that would occur naturally through exposure to the atmosphere at room conditions. Or in some embodiments, the curing of the coating may be expedited by exposure to both ultraviolet radiation and elevated temperature.

In some embodiments, at least a portion of the curing step takes place before de-masking of the interior surface of the structure 12. For example, in some embodiments, it may be desirable to perform at least a portion of the curing step in order to avoid running of the coating into the unmasked portion 17 of the interior surface after the de-masking step. In other embodiments, the curing step may take place after the de-masking of the interior surface of the structure 12 and, optionally, after the removal of the masking unit 20 from the interior cavity 15 of the structure.

The methods of the present disclosure may be performed in a motorized manner. For instance, the methods of the present disclosure may be performed as part of a continuous or semi-continuous high-scale manufacture of the coated structure. By careful control over the motion of the structure 10, the masking unit 20, and/or the magnetic source 30, high quality selective coatings of an interior surface 12 may be performed. The systems described herein may also be reusable, thereby providing economic and environmental benefits over chemical-based masking materials.

It will be apparent to those skilled in the art that the methods and apparatuses disclosed herein could be applied to a variety of structures having different geometries and to create selectively coated and uncoated portions of varying shapes, sizes, and orientations. It will also be apparent to those skilled in the art that various modifications and variations can be made without departing from the spirit or scope of the invention.

What is claimed is:

1. A system for masking and de-masking a portion of an interior surface of a structure comprising:

(a) a masking unit comprising at least a body and a handle, the body comprising
  (i) a magnetically active material, and
  (ii) a seal-forming material; and (b) an object that is configured to produce a magnetic force that acts on an interior cavity of the structure;

wherein the masking unit is configured to be inserted into the interior cavity of the structure; and wherein the magnetic force is configured to cause the masking unit to sealably contact the portion of the interior surface of the structure, and wherein the object is an electromagnet.

2. The system of claim 1, in which the handle is configured to flex in response to application of the magnetic force.

3. The system of claim 2, in which the handle is configured to return to its natural position in response to a removal of the magnetic force.

4. The system of claim 1, in which the masking unit is configured to provide the structure with a viewing aperture.

5. The system of claim 1, in which the masking unit is less than 6 mm thick.

6. A system for masking and de-masking a portion of an interior surface of a structure comprising:

(a) a masking unit comprising at least a body and a handle, the body comprising
  (i) a magnetically active material, and
  (ii) a seal-forming material; and (b) an object that is configured to produce a magnetic force that acts on an interior cavity of the structure;

wherein the masking unit is configured to be inserted into the interior cavity of the structure; and wherein the magnetic force is configured to cause the masking unit to sealably contact the portion of the interior surface of the structure, and wherein the object is a permanent magnet.

7. The system of claim 6, in which the handle is configured to flex in response to application of the magnetic force.

8. The system of claim 7, in which the handle is configured to return to its natural position in response to a removal of the magnetic force.

9. The system of claim 6, in which the masking unit is configured to provide the structure with a viewing aperture.

10. The system of claim 6, in which the masking unit is less than 6 mm thick.

* * * * *